United States Patent [19]

Fournier et al.

[11] Patent Number: 4,573,520

[45] Date of Patent: Mar. 4, 1986

[54] APPARATUS FOR RAPID TEMPERING A METAL OR ALLOY ON A MOVING BELT

[75] Inventors: Pascal Fournier, Nancy; Jean-Claude Peraud, Perigny sur Yerres, both of France

[73] Assignee: Pont A Mousson S.A., Nancy, France

[21] Appl. No.: 458,080

[22] Filed: Jan. 14, 1983

[30] Foreign Application Priority Data

Jan. 21, 1982 [FR] France ..... 82 00896

[51] Int. Cl.[4] ..... B22D 11/06; B22D 27/15

[52] U.S. Cl. ..... 164/253; 164/415; 164/423

[58] Field of Search ..... 164/463, 423, 462, 474, 164/475, 61, 65, 66.1, 67.1, 68.1, 253–258, 259, 415

[56] References Cited

U.S. PATENT DOCUMENTS

| | | | |
|---|---|---|---|
| 2,285,847 | 6/1942 | Taylor | 164/254 |
| 2,384,500 | 9/1945 | Stell | 427/251 |
| 3,670,400 | 6/1972 | Singer | 164/463 X |
| 4,274,473 | 6/1981 | Bedell et al. | 164/463 X |

FOREIGN PATENT DOCUMENTS

| | | | |
|---|---|---|---|
| 56-68558 | 6/1981 | Japan | 164/463 |

*Primary Examiner*—Kuang Y. Lin

*Attorney, Agent, or Firm*—Sughrue, Mion, Zinn, Macpeak, and Seas

[57] ABSTRACT

An apparatus for rapidly quenching a metal or alloy in the molten state by projecting a jet thereof from a crucible 7 onto a cooled belt 1 moving at high speed inside a vacuum chamber 3. The crucible is mounted outside of and above the chamber, with its curved bottom, provided with a casting orifice 14, resting on the rim 5' of an opening provided in the upper cover 6 of the chamber.

3 Claims, 4 Drawing Figures

APPARATUS FOR RAPID TEMPERING A METAL OR ALLOY ON A MOVING BELT

BACKGROUND OF THE INVENTION

This invention relates to the manufacture of rapidly quenched ribbons by projecting a liquid jet of metal or alloy onto a cooled belt moving at high speed, and especially to a technique for contacting the jet with the belt in a reduced pressure atmosphere.

French patent application No. 80 15 918 filed on July 18, 1980 describes an apparatus comprising a vacuum chamber through which a moving belt passes. A crucible having an ejection orifice for the liquid jet and a high frequency induction heater winding for the crucible are disposed such that they extend into the chamber.

Such a structure requires the production and maintenance of vacuum sealed joints at the points of penetration of the crucible and winding through the wall of the chamber. This structure also requires that the chamber become more voluminous and complex as the crucible capacity increases, since in such case greater care must be taken to seal the chamber and maintain the crucible in place (in order to balance the forces exerted on the joint by atmospheric pressure), as well as the insulation and cooling means.

SUMMARY OF THE INVENTION

An object of this invention is to eliminate these constraints by arranging the crucible outside of and above the vacuum chamber. The lower part of the crucible, fitted with a casting orifice, rests in a sealed manner on the rim of an opening in the upper part or cover of the chamber.

In a preferred embodiment the rim contains a bed having a shape complementary to that of the bottom of the crucible. A sealing joint or washer, with an adapted shape and composed of a material which is a poor heat conductor, is interposed between the bed and the bottom.

Another embodiment consists of using, in order to constitute the bed, a component in a material which is a poor heat conductor, and of carrying out grinding of the crucible on contact with said bed. Preferably again, moreover, flat geometry can be selected for the surfaces thus ground.

DETAILED DESCRIPTION OF THE PREFERRED EMBODIMENTS

Figure 1:
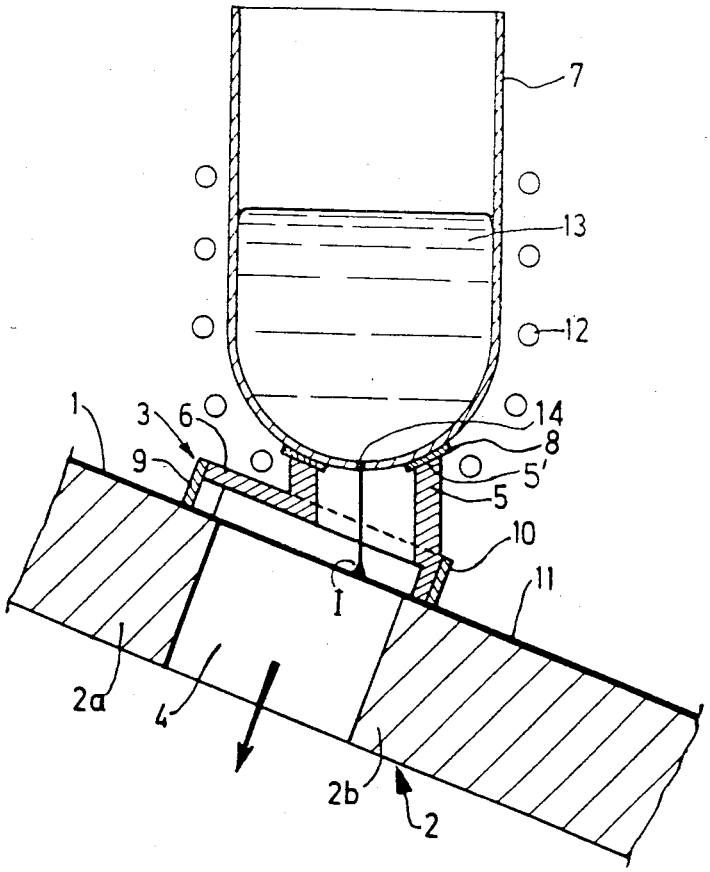
FIG. 1 is a partial cross-section of a rapidly quenching apparatus in accordance with the invention.

With reference first to FIG. 1, a moving belt 1 is driven at high speed (by means not shown) above a shoe 2 containing, along at least part of its length, a plenum 2*a*, 2*b* for establishing a gaseous Coanda effect cushion. Beneath a vacuum chamber 3, one or more vacuum passages 4 are connected to a vacuum pumping assembly (not shown). Chamber 3 includes a tubular support 5 which forms an integral part of its cover 6, and whose upper rim-forming edge 5' is tooled so that the mating bottom of a crucible 7 may be applied thereto with the interposition of a washer 8 made of refractory fibers, thus providing both a tight seal and thermal insulation.

The lateral walls of the vacuum chamber 3 are supported, at their lower ends and on the upper surface of the shoe 2, by input and output gates 9, 10 configured as embrasures of appropriate size and shape to define, together with the upper surface of the shoe, slits for the entry of the belt 1 and for the exit of the belt carrying a hypertempered ribbon 11. Gates 9 and 10 embody joints for sealing against the chamber 3 and can be removed, for example by sliding upwardly, in the event that the ribbon should stick to the belt.

An induction coil 12 arranged around the lower end of crucible 7 provides high frequency induction heating to maintain the metal or alloy product 13 to be rapidly quenching in a liquid or molten state, whereby it may be discharged from the crucible through a casting orifice 14 to form a ribbon 11 on the relatively cool belt. Complementary means for fusing and supplying the melted product to the crucible 7 (not shown in FIG. 1) are arranged above the crucible in order to facilitate the continuous operation of the installation. In particular, such supply means enable regulating the level of the product contained in the crucible, as well as the nature and pressure of the atmosphere to which the product in the crucible is exposed.

The output gate 10 may comprise, as described in French patent application No. 80 15 918, a wing disposed at right angles to the lateral chamber wall, such wing forming a tunnel or draft hood above the ribbon in the direction of the point of impact (I) of the liquid jet with the moving belt. As an alternative to such a wing at right angles, a flat output gate 10 may be used, mounted on a hinge and thus functioning as a safety vane which opens in the event of jamming. The vane repositions itself again after the incident, and has an overlaid sealing joint drawn closed by the vacuum in the chamber. This same vacuum effect also ensures sealing between the chamber wall and other various elements of the vacuum chamber including; input gate 9 and observation portholes (not shown). The vacuum effect also ensures sealing between the bottom of crucible 7 and the tubular support 5.

The improved apparatus of this invention provides, in particular, the following advantages with respect to the crucible:

(a) facility of continuous supply of the crucible, (b) facility of replacement of the crucible (even by a crucible with a different diameter, by only changing the inductor), (c) lesser requirements with respect to the performances of the materials used and to the precision of manufacture of the crucible, which may have varied shapes, and (d) reduction of mechanical constraints, possibly of thermal origin, in view of the transfer of the sealing joint from its cylindrical part to its base, and of the homogeneity of temperature of the crucible assembly.

Further, it is no longer necessary to energetically cool the vacuum chamber, which can be manufactured very easily.

Figure 2:
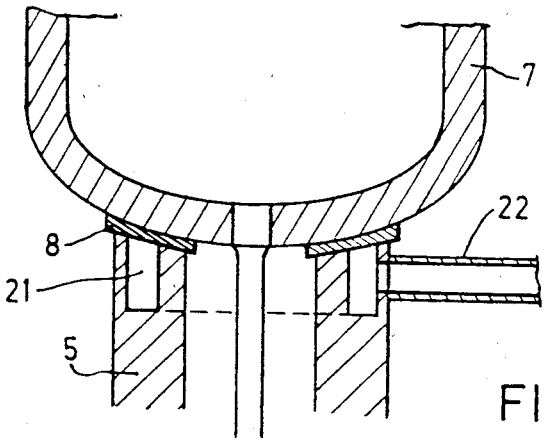
FIG. 2 is a detailed view, on a larger scale, of an alternative embodiment of the invention.

A possible leakage of air towards the vacuum chamber may take place at the joint between the bottom of the crucible 7 and the rim 5' of the tubular support 5, due to the reduced pressure and the differences in temperature between the components in contact. Such leakage may be prevented by establishing a gas sweep at the joint, in particular using an antioxidation gas. For this purpose the alternative tubular support shown in FIG. 2 may be used, where the components described above retain the same reference numerals.

In this embodiment an annular groove 21, for example with a trapezoidal cross-section, has been provided in the thickness of the upper part of tubular support 5, preferably close to the lateral outside surface of the support. Groove 21 provides for the homogeneous distribution of a gas (nitrogen, hydrogen, argon or, preferably, helium) introduced by a tube 22. Since the material constituting washer 8 is gas-permeable, the entry of air into the vacuum chamber is effectively countered and the integrity of the atmosphere in which the casting of the product to be rapidly quenched takes place is maintained.

Figure 3:
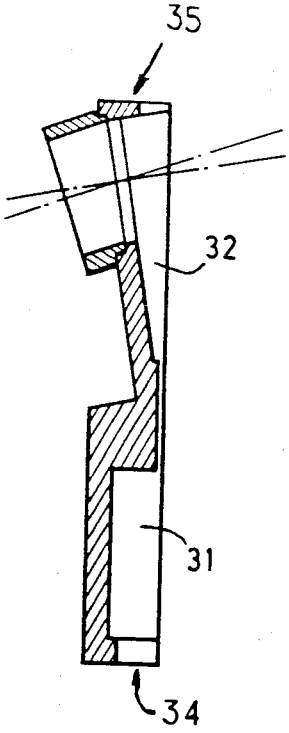
FIGS. 3 and 4 are cross-sections of two types of vacuum chambers which may be used in the apparatus of the invention.
Figure 4:
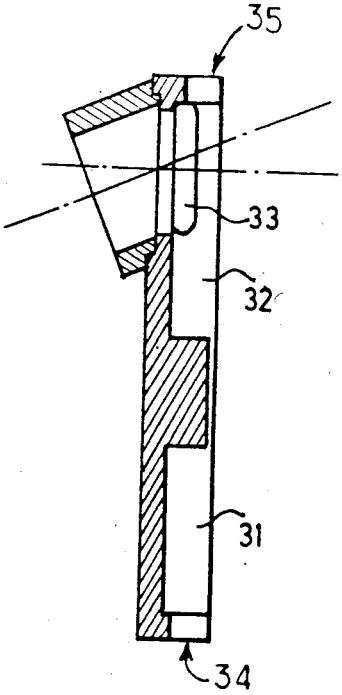

FIGS. 3 and 4 represent particular examples of vacuum chambers in accordance with the invention, in both of which a lock-chamber 31 is provided upstream, in the direction of movement of the belt, of the casting chamber 32. The lock-chamber 31 maintains a transitional region in which the belt passes between atmospheric pressure and the reduced pressure at which the casting is carried out within the casting chamber 33. In spite of the very reduced size of the chamber, observation windows 33 can be provided laterally in the chamber as shown in the embodiment of FIG. 4.

The surfaces intended to contact the support shoe are grooved at the input and output ends with embrasures 34 and 35, respectively, which are masked during operation by the complementary gates 9 and 10 as described above. The vacuum chambers of FIGS. 3 and 4 as illustrated, mount the support 5 into alignment with the system in FIG. 1.

The apparatus of the invention enables the manufacture of metallic ribbons having excellent surface qualities and which are very well tempered by maintaining a reduced pressure, on the order of one-tenth of an atmosphere, in the casting chamber. A very low helium flow, for example of one liter per minute, is sufficient to prevent any entry of air at the level of washer 8.

What is claimed is:

1. An apparatus for rapidly quenching a metal or an alloy in a molten state, comprising:

(a) a cooled belt (1) driven at a high speed, (b) a vacuum chamber (3) disposed around a portion of the belt, said vacuum chamber comtains a casting chamber (32), and upstream thereof, a lock-chamber (31) for maintainingthe transition between the atmosphere pressure and the reduced pressure in which casting is carried out, (c) an opening in an upper cover (6) of the chamber terminating in a seating rim (5'), wherein said opening is provided at the end of a tubular support (5) projecting from the upper cover of the chamber, (d) a crucible (7) disposed outside of the chamber and having a bottom portion resting on the seating rim and wherein said seating rim has a configuration complementary to that of the bottom of the crucible, and (e) a casting orifice (14) in said bottom portion of the crucible, whereby a jet of liquid metal or alloy projected through the orifice and onto the moving belt is formed into a rapidly quenched ribbon, (f) a gas-permeable sealing washer (8) interposed between said rim and said bottom portion of said crucible, (g) means for sweeping the area between the crucible bottom and the seating rim with an antioxidation purge gas, said sweeping means comprises an annular groove (21) in the rim connected to a source of purge gas.

2. The apparatus of claim 1, wherein said washer is made of a material which is a poor heat conductor, such as refractory fibers.

3. The apparatus of claim 1, wherein said vacuum chamber contains observation windows.

* * * * *